United States Patent [19]

Tennant

[11] 4,263,474

[45] Apr. 21, 1981

[54] UNDER CARPET CABLE CONNECTOR

[75] Inventor: Robert J. Tennant, Seminole, Fla.

[73] Assignee: AMP Incorporated, Harrisburg, Pa.

[21] Appl. No.: 43,966

[22] Filed: May 30, 1979

[51] Int. Cl.[3] ..... H01R 4/18

[52] U.S. Cl. ..... 174/84 C; 174/88 R; 339/97 C; 339/276 R

[58] Field of Search ..... 174/71 R, 84 C, 88 R; 339/97 C, 98, 276 R, 276 F, 276 T

[56] References Cited

U.S. PATENT DOCUMENTS

| | | | |
|---|---|---|---|
| 2,020,408 | 11/1935 | Fruth . | |
| 2,250,280 | 7/1941 | Starbird | 173/324 |
| 3,138,658 | 6/1964 | Weimer, Jr. | 174/84 C X |
| 3,247,316 | 4/1966 | Weimer, Jr. | 174/94 |
| 3,541,226 | 11/1970 | Cea et al. | 174/84 C |
| 3,541,227 | 11/1970 | Bendrick | 174/94 |
| 3,662,089 | 5/1972 | Harding | 174/84 C |
| 3,752,901 | 8/1973 | Kuo | 174/84 C |

*Primary Examiner*—Roy N. Envall, Jr.

*Attorney, Agent, or Firm*—Anthony S. Volpe; Gerald K. Kita

[57] ABSTRACT

A connector for use in terminating flat conductors which provides a minimum profile. The connector employs coined contact rings which pierce the conductor insulation and establish electrical contact without conductor damage. A lance and guide hole arrangement provides alignment and mechanical locking of the connector.

10 Claims, 15 Drawing Figures

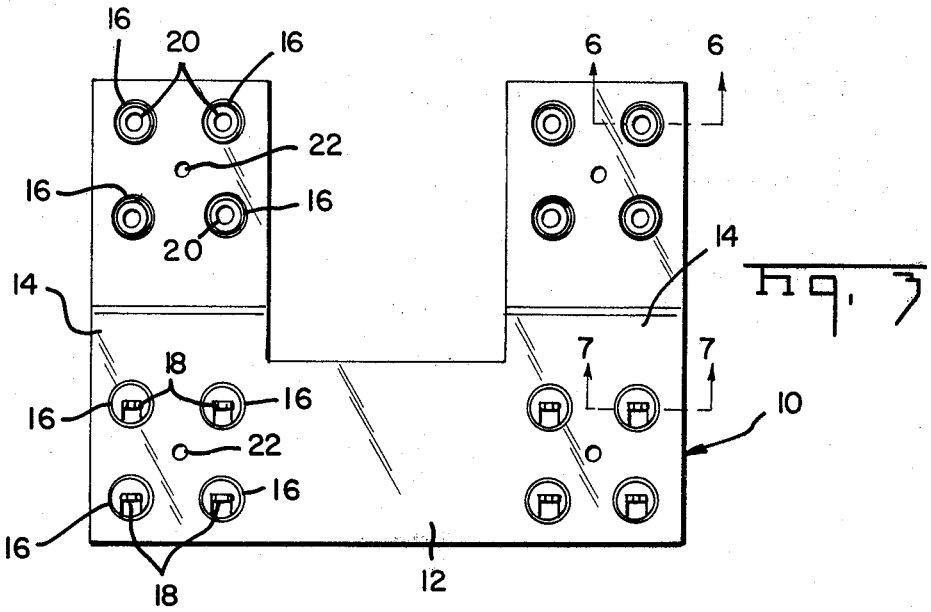
Fig. 3
Fig. 4
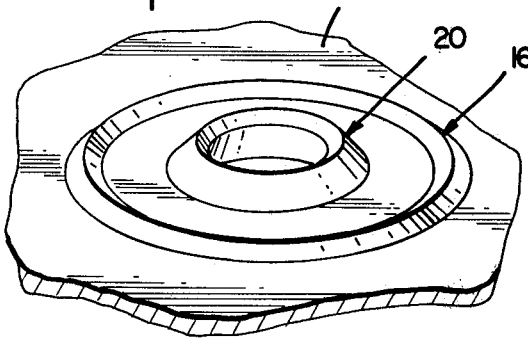
Fig. 5
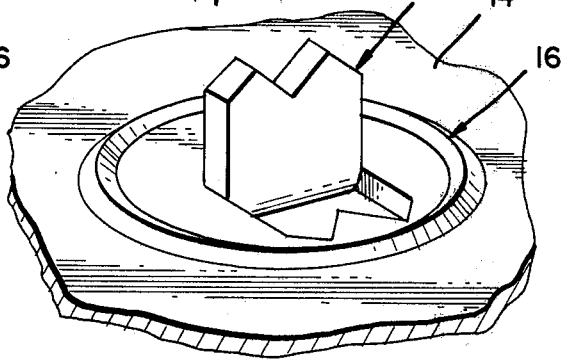
Fig. 6
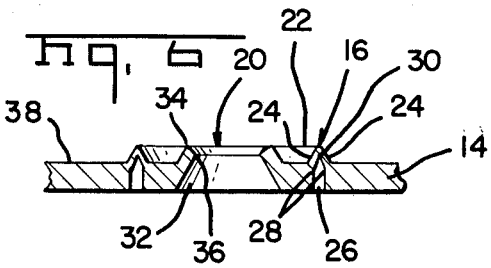
Fig. 7
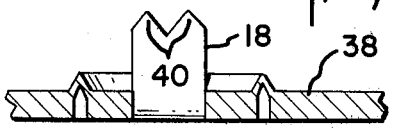

UNDER CARPET CABLE CONNECTOR

BACKGROUND OF THE INVENTION

1. Field of the Invention

The present invention is for use with flat conductor cable which generally comprises a tape-like strip of suitable insulation in which there are embedded a plurality fo ribbon-like conductors extending parallel to each other. Conductor cable of this type has been widely available for some years although conventional terminating and crimping techniques as are commonly applied to round wires are not applicable to this type of cable. As a result, a wide variety of specialized types of connecting devices has been developed for flat conductor cable. This invention lies in the broad field of flat conductor cable connectors.

2. Description of the Prior Art

The prior art shows a number of connectors for flat conductor cables; however, the prior art devices generally are unsatisfactory due to their height of termination, multiple parts and/or special tooling required for termination. The present invention solves the prior art problems by providing a minimum termination profile and simplified termination.

BRIEF SUMMARY OF THE INVENTION

In accordance with a preferred embodiment of the invention, the connector has a plurality of contact rings located on opposed surfaces for establishing electrical contact with a flat conductor. One surface of said connector has a plurality of guide holes located within the contact rings and the other surface has a plurality of lance means located within the contact rings. The lances pierce the flat conductor and pass through the guide holes of the opposing surface. A simple press means is utilized to deform the lances behind the guide holes and establish a mechanical connection to secure the electrical termination.

It is an object of this invention to provide a minimum profile connector for flat conductors.

It is an object of this invention to provide a mimimum profile connector for flat conductors which is independent of the spring quality of the material used to fabricate the connector.

It is an object of this invention to provide a connector for making the transition from a flat conductor to a round conductor.

It is an object of this invention to provide a connector which is easily manufactured.

It is an object of this invention to provide a connector having a minimum profile which is compatible with the space occupied by conductor in a flat conductor cable.

BRIEF DESCRIPTION OF THE DRAWINGS

FIG. 3 is a plan view of a butt splice connector before folding.

FIG. 4 is a three dimensional view of the contact ring and guide hole fragmented from a connector according to the instant invention.

FIG. 5 is a three dimensional view of the contact ring and lance fragmented from a connector according to the instant invention.

FIG. 6 is a section through the lines 6—6 of FIG. 3.

FIG. 7 is a section through the lines 7—7 of FIG. 3.

DESCRIPTION OF THE PREFERRED EMBODIMENT

Figure 1:
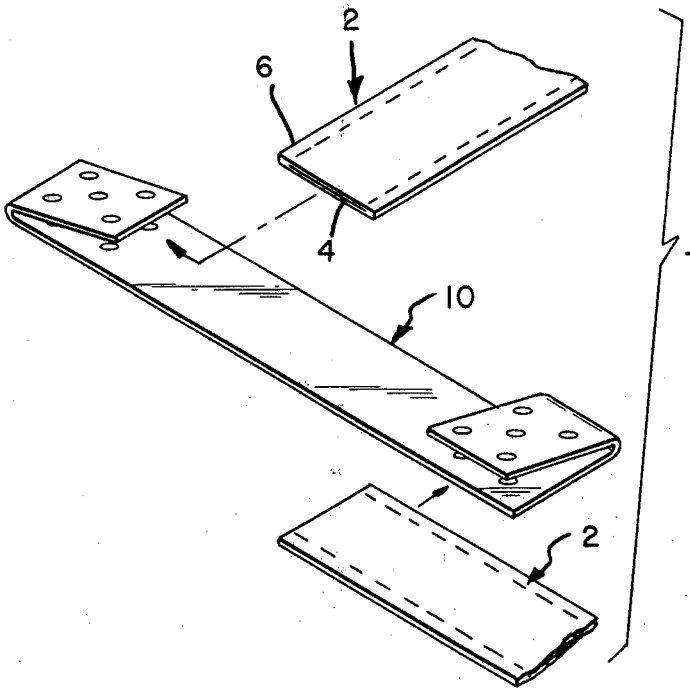
FIG. 1 is a three dimensional view of a tap splice connector before application to a cable.

Referring to FIG. 1, there is shown a 90° tap connector 10 according to the instant invention with the cables 2 exploded out. Cable 2 has a flat conductor 4 with a thickness of approximately 0.009 in. (0.2286 mm) and two layers of insulation 6 of approximately 0.006 in. (0.1524mm) thick Mylar. The presently preferred material for use in the fabrication of terminal 10 is 0.016 in. (0.4064mm) thick quarter hard brass.

Figure 2A:
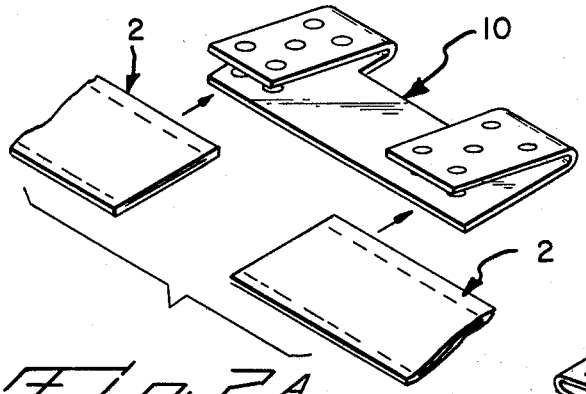
FIG. 2A is a three dimensional view of a butt splice connector before application to the cables.
Figure 2B:
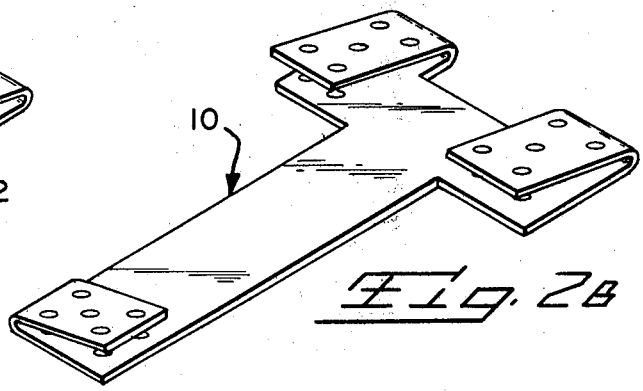
FIG. 2B is a three dimensional view of a combination butt-tap splice connector.
Figure 12:
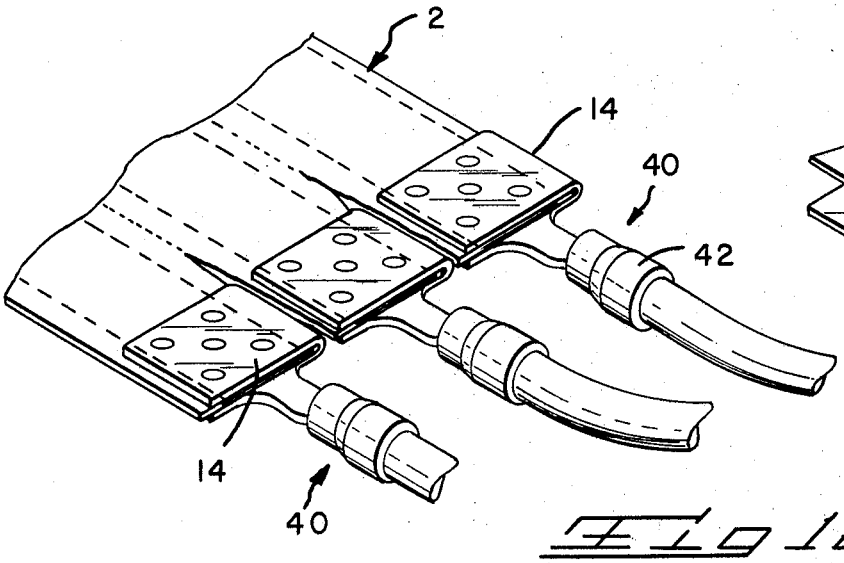
FIG. 12 is an illustration of the connector of FIG. 11 as applied to a three conductor cable.

FIGS. 2A and 2B illustrate a butt splice and butt splice-tap respectively; however, it is obvious that other configurations are possible.

Referring now to FIG. 3, the connector 10 has a web 12 which electrically connects and is integral with the termination means 14. Termination means 14 has a first plate which has four contact rings 16 which surround sawtooth lances 18 and a second plate which has four contact rings 16 which surround counterbores 20. Centerholes or pilot holes 22 are located at the intersection of centerlines through contact rings 16 and on centerlines with each other. Centerholes 22 serve as manufacturing aides to assure centerline positioning among the plurality of contact rings.

Referring now to FIGS. 4 and 5, there is shown respectively a single contact ring 16 surrounding counterbore 20 and lance 18. Referring to FIG. 6, contact ring 16 is formed by coining the material of termination means 14 upward to form a ridge. Edge 22 of contact ring 16 has a maximum flat of 0.002 in. (0.0508mm) and a height of approximately 0.008 in. (0.2032mm) above flat 38. Surfaces 24 are sloped from edge 22 at an angle of 60°. Coining void 26 is approximately 0.009 in. (0.2286mm) wide and 0.021 in. (0.5334mm) deep; surface 28 has an 48° angle as measured from tip 30.

Counterbore 20 is formed by prepunching the material of terminating means 14 upward with a tapered punch to form taper 32 and then counterboring downward to obtain counterbore 20 with flat 34 being sharp to approximately 0.002 in. (0.0508mm). Ridge 36 is formed at the union of counterbore 20 and taper 32.

Referring now to FIGS. 5 and 7, contact ring 16 is formed as previously described. Sawtooth lance 18 is stamped and formed from the material of termnation means 14, with a width approximately equal to a diameter across flat 34 of counterbore 20 and a height of approximately 0.052 in. (1.3208mm) above flat 38. Tips 40 are located approximately 0.010 in. (0.254mm) in from the edges of the lance 18.

Figure 8:
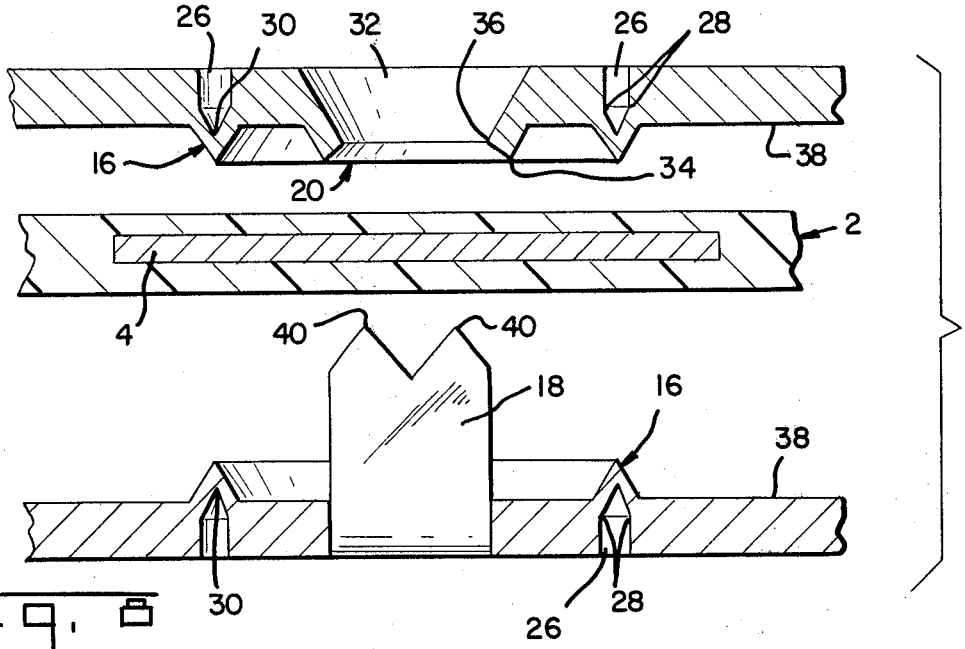
FIG.8 is a fragmentary sectional view of before application to a conductor.
Figure 9:
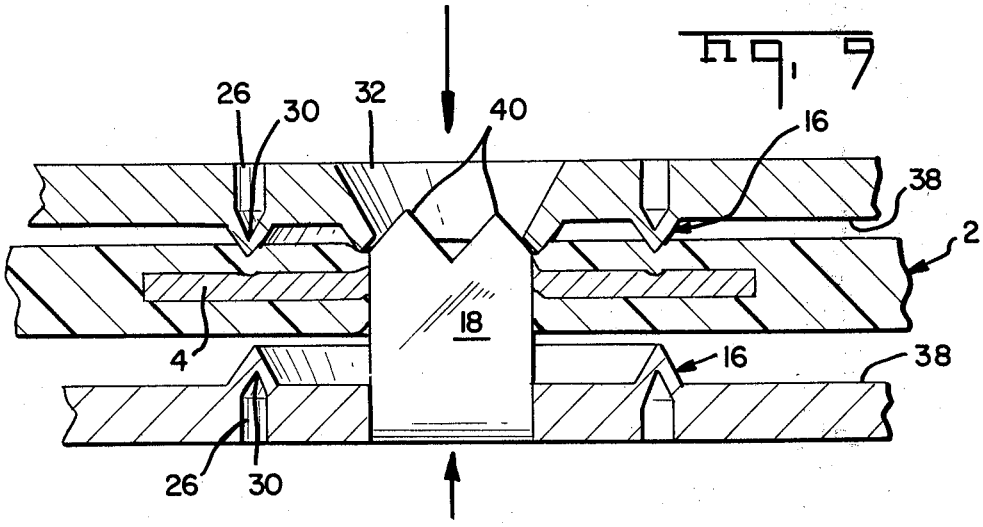
FIG. 9 is a fragmentary sectional view during application to a conductor.

Referring again to FIG. 1, it can be seen that in practice the termination means 14 is folded back on itself to approximately a 20° angle to generally align counterbores 20 over sawtooth lances 18. In use a ribbon conductor is located in the fold of termination means 14 as shown in FIG. 8. Termination means 14 is then pressed together with suitable flat surfaced tooling such as a simple handpress. As shown in FIG. 9, the sawtooth lance 18 will locate in counterbore 20 and establish precise alignment of opposing contact rings 16. Notice that the flat 34 is in interference contact with the outer edge of lance 18. As termination means 14 is compressed lance 18 becomes deformed behind ridge 36, contact ring 16 pierces the insulation over conductor and establishes an interference electrical contact therewith. Termination means 14 is compressed to a total connection height of approximately 0.055 in. (1.397mm). Sawtooth lance 18 is of sufficient height to penetrate through the stacked height of the connector material and cable and provide sufficient material for deformation as a mechanical locking means for the connector.

Figure 10:
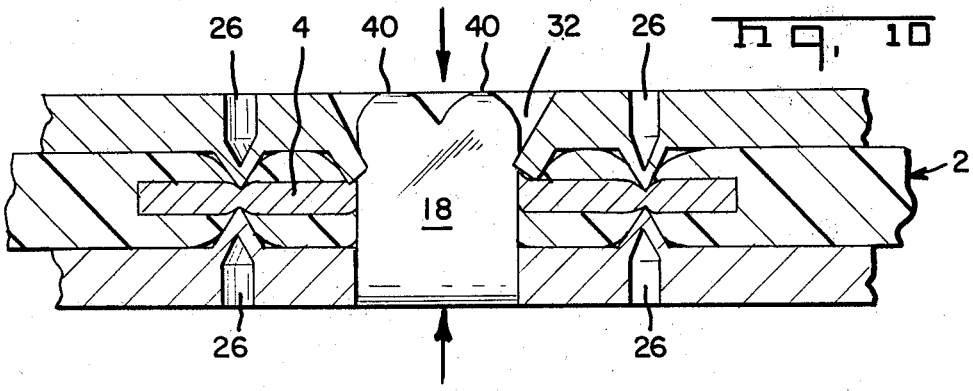
FIG. 10 is a fragmentary sectional view after application to a conductor.
Figure 13:
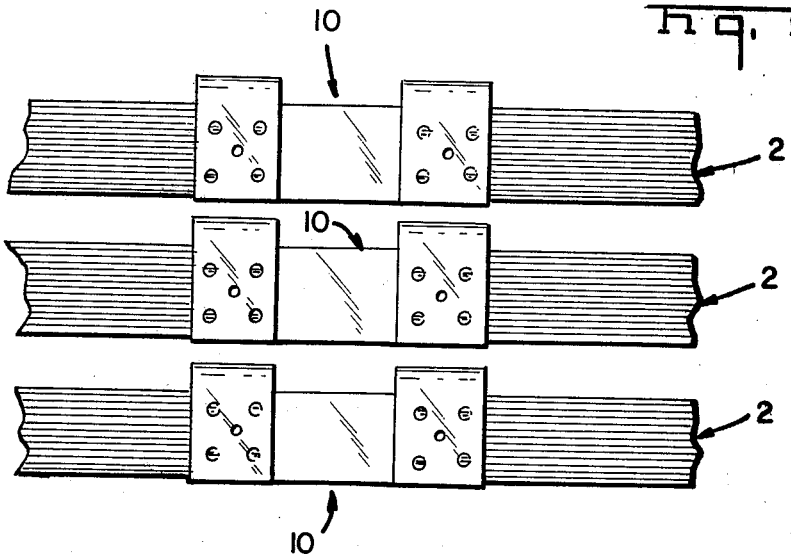
FIG. 13 is an illustration of the butt splice of FIG. 2A as applied to a three conductor cable.
Figure 14:
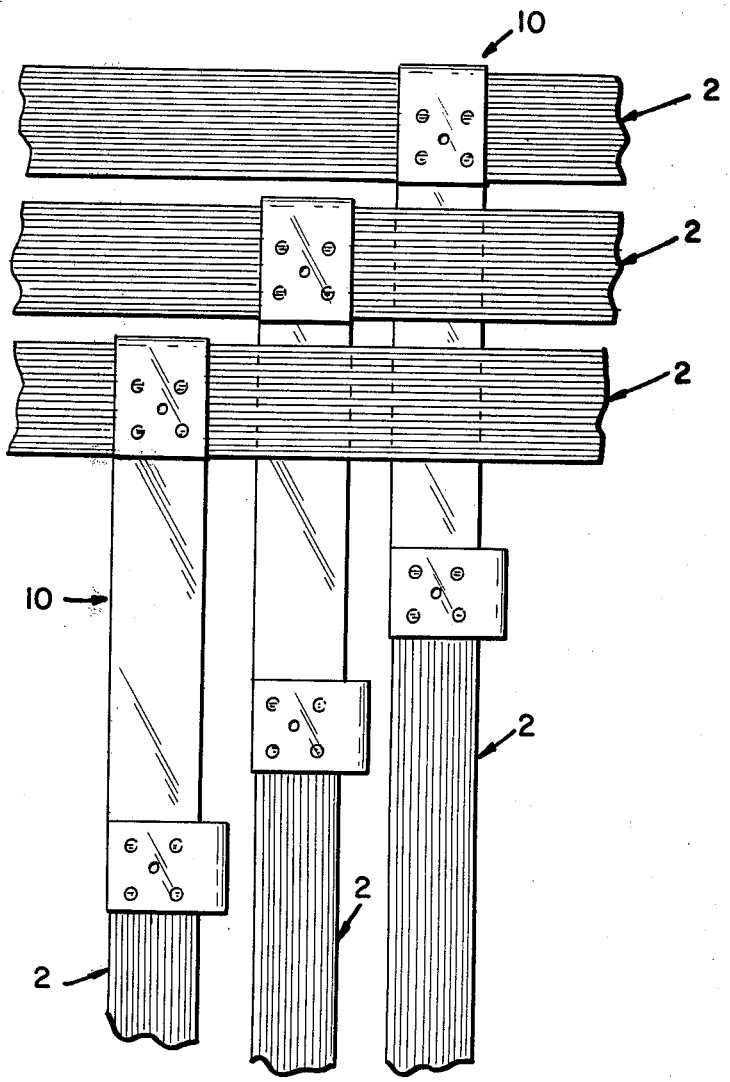
FIG. 14 is an illustration of the tap splice of FIG. 1 as applied to a three conductor cable.

FIG. 10 shows a completed termination. Given a 0.009 in (0.2286mm) conductor 4 with insulation 6 of 0.006 in. (0.1524mm) on either side thereof it can be seen that the termination of the instant invention increases the height of the connection only by the thickness of the material used to fabricate termination means 14. It should also be recognized that contact rings 16 will sever the insulation 6 and embed themselves into the conductor approximately 0.002 in. (0.0508mm) on either side thereof, hence the conductor will not be served as electrical termination is achieved.

The termination shown in FIG. 10 is then bandaged with Mylar or other suitable insulation and waterproofing.

Figure 11:
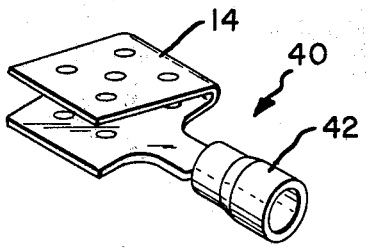
FIG. 11 is a three dimensional view of a flat to round conductor connector according to the instant invention.

FIG. 11 illustrates a transition connection 40 for interconnecting flat and round conductors. Flat conductor termination means 14 is a previously described hereinabove. Round conductor termination means 42 is a preinsulated-insulation piercing barrel connector which in the preferred embodiment incorporates means to prevent overinsertion of the conductor in the wire barrel. A suitable round conductor terminating means 42 is disclosed in U.S. Pat. No. 3,605,077.

Although preferred embodiments of the present invention are disclosed and shown in detail, other modifications and embodiments which would be apparent to one having ordinary skill in the art, are intended to be covered by the spirit and scope of the claims.

What is claimed is:

1. An electrical connector comprising:

first and second electrically connected termination means, said first and second termination means being comprised of first and second opposed surfaces, said first opposed surface having a plurality of contact rings thereon and a guide hole located within each of said plurality of contact rings, said second opposed surface having a plurality of contact rings, equal to said plurality of contact rings on said first opposed surface, thereon and a lance means located within each of said plurality of contact rings, whereby upon moving said opposed surfaces together, said lances pass through said guide holes and said plurality of contact rings on said first surfaces are in alignment with said plurality of contact rings on said second surface.

2. A stamped and formed electrical connector comprising:

first and second termination means electrically connected by an integral web, said first and second termination means further comprising first and second opposed surfaces having a pilot hole on centerline with each other, said first opposed surface having a plurality of contact rings radiated about said pilot hole and a pluraity of guide holes radiated about said pilot hole, said second opposed surface having a plurality of contact rings, equal in number to said contact rings on said first surface, radiated about said pilot hole, at a distance equal to said contact rings on said first surface, and a plurality of lance means equal in number to and on center with said plurality of guide holes in said first opposed surface.

3. A stamped and formed electrical connector according to claim 2 wherein:

said plurality of guide holes in said first opposed surface are equal in number to said contact rings thereon and are centered within said contact rings, and said plurality of lance means on said second opposed surface are equal in number to said guide holes and are centered within said contact rings on said second surface.

4. A connector for electrical connection to a flat conductor, comprising:

one or more pairs of flat metal plates, with said plates of each pair integrally joined along a fold, each of said plates having one or more ridges projecting outwardly toward and in alignment with respective said one or more ridges of the other plate of the same pair, a first plate of each said pair being provided with one or more lances bent out of the thickness of said first plate and projecting toward a respective second plate of the same pair, said second plate of each said pair being provided with one or more apertures, each of a diameter less than the width of a respective one of said lances, and each being encircled by a lip projecting outwardly toward a respective said first plate of the same pair, each said pair of plates being constructed for being folded against opposite surfaces of a respective, insulation covered, flat conductor, with said ridges of said pair of plates penetrating through said insulation and penetrating partially into said flat conductor for establishing a completed electrical connection therewith, and with each said lance projecting through said flat conductor and wedgingly retaining in a respective aperture, lockingly retaining a respective said pair of plates against said flat conductor, and aligning said ridges on a respective pair of plates directly opposite one another across the thickness of said flat conductor.

5. The structure as recited in claim 4, wherein, the height of said completed electrical connection is the sum of thicknesses of said metal plates and said insulation covered flat conductor.

6. The structure as recited in claim 4, wherein, each said lance is bounded by a respective said ridge of a respective said first plate, and each said aperture is bounded by a respective said ridge of a respective said second plate.

7. The structure as recited in claim 4, wherein, at least one of said metal plates of each said pair is provided with means projecting outwardly of said pair when folded against said flat conductor for electrically connecting to an electrical wire.

8. The structure as recited in claim 4, wherein, each said first plate includes a first pilot hole therethrough precisely spaced from each said lance, and each said second plate includes a second pilot hole therethrough precisely spaced from each said aperture.

9. The structure as recited in claim 8, wherein, each said first pilot hole is equidistant from each said lances provided on the same said first plate, and each said second pilot hole is equidistant from each said apertures provided through the same said second plate.

10. The structure as recited in claim 6, wherein, each said lip provides a tapered counterbore for a respective said aperture, and each said lance free end thereof is of reduced width to enter a respective said tapered counterbore.

* * * * *